United States Patent [19]

Grassi

[11] 4,345,395

[45] Aug. 24, 1982

[54] METHOD AND APPARATUS FOR PRODUCING DAY-NIGHT PICTURES

[76] Inventor: Gloria Grassi, 1511 E. Highland Ct., Ontario, Calif. 91764

[21] Appl. No.: 211,737

[22] Filed: Dec. 1, 1980

[51] Int. Cl.[3] ..... G09F 19/00; G09F 13/06; A63J 3/00

[52] U.S. Cl. ..... 40/441; 40/579; 40/437; 40/406; 362/811; 272/8 D

[58] Field of Search ..... 40/160, 442, 427, 439, 40/441, 440, 431, 406, 436, 437, 438, 432, 444, 541, 580, 152.2, 579, 443; 362/806, 811, 812; 428/3, 7, 8, 9; 272/8 D

[56] References Cited

U.S. PATENT DOCUMENTS

| | | | |
|---|---|---|---|
| 1,211,239 | 1/1917 | Ryan | 40/442 |
| 1,348,957 | 8/1920 | Pope | 40/444 |
| 1,403,631 | 1/1922 | Pyper | 40/438 |
| 1,429,802 | 9/1922 | Thompson | 40/443 |
| 1,671,071 | 5/1928 | Gritt | 40/441 |
| 2,015,170 | 9/1935 | Ward | 40/543 |
| 2,020,087 | 11/1935 | Treshansky et al. | 40/442 |
| 2,163,763 | 6/1939 | Ray | 40/442 |
| 2,225,307 | 12/1940 | Kreeger | 40/443 |
| 2,811,798 | 11/1957 | Brooks | 272/8 D |
| 2,826,844 | 3/1958 | Leika | 40/152.2 |
| 3,163,554 | 12/1964 | Gessler | 40/443 |
| 3,517,937 | 6/1970 | Glass et al. | 40/152.2 |
| 3,538,323 | 11/1970 | Ziegler | 40/431 |
| 3,688,424 | 9/1972 | Von Zanten | 40/436 |
| 3,762,082 | 10/1973 | Mincy | 362/811 |
| 3,793,755 | 2/1974 | Gersh et al. | 362/811 |
| 3,831,302 | 8/1974 | Gentilini | 40/431 |
| 4,034,494 | 7/1977 | Lane | 40/427 |
| 4,250,537 | 2/1981 | Roegner et al. | 362/811 |

FOREIGN PATENT DOCUMENTS

| | | | |
|---|---|---|---|
| 978365 | 6/1964 | United Kingdom | 40/441 |

*Primary Examiner*—Robert Peshock
*Assistant Examiner*—Michael J. Foycik
*Attorney, Agent, or Firm*—Weissenberger and Peterson

[57] ABSTRACT

A day-night picture achieves a realistic reproduction of the twinkling of distant city lights or the like, by backlighting small apertures in the picture with a fine, randomly moving reflection pattern obtained by suspending pieces of crumpled reflective foil from fine threads behind the picture above a light source whose heat creates convection currents which slowly move the foil pieces in a random manner.

7 Claims, 3 Drawing Figures

METHOD AND APPARATUS FOR PRODUCING DAY-NIGHT PICTURES

BACKGROUND OF THE INVENTION

It has long been known that striking artistic effects can be achieved by pictures capable of representing a landscape or the like in the daylight and also at night. Traditionally, this has been achieved by providing small translucent apertures in an opaque surface carrying the picture, at those points where lights would appear at night in the scene. These apertures are not noticeable in the overall effect of the scene when an observer looks at it in daylight; but when they are backlighted in a darkened room, the picture assumes a nighttime appearance. This type of picture is particularly effective for the representation of distant scenes such as, for example, the scene of a city viewed from a hill or across a body of water. When such a scene is observed in nature, thermal currents in the air between the observer and the city cause increasingly distant lights to increasingly twinkle in a familiar manner which is difficult to reproduce.

Attempts have been made to reproduce the twinkling of stars in day-night pictures (see U.S. Pat. No. 3,688,424 to Von Zanten); the twinkling of sunlight on water (by the relative movement of a picture carrier and a grid); or a change in appearance of a picture by using movable backlighting reflectors (see U.S. Pat. No. 4,034,494 to Lane). None of these technologies, however, are capable of satisfactorily reproducing the appearance of a distant city scene at night.

SUMMARY OF THE INVENTION

The invention achieves the desired effect by continuously varying the backlighting of the picture in a fine, randomly arranged and randomly moving pattern of varying illumination intensities which is very close in appearance to the random pattern created by air currents in nature. This is achieved, in the preferred embodiment of the invention, by placing a light source behind and underneath the picture, and suspending from very fine threads, above the light source and directly behind the picture, pieces of crumpled aluminum foil. Air currents created by the heat of the light source cause the aluminum foil to twist and move in a random pattern, and the randomly varying reflectivity of individual elements of the crumpled foil surface causes constantly moving reflections. These reflections, when viewed from the front of the picture in a darkened room, closely resemble the twinkling of lights in a distant city scene.

DESCRIPTION OF THE PREFERRED EMBODIMENT

Figure 1:
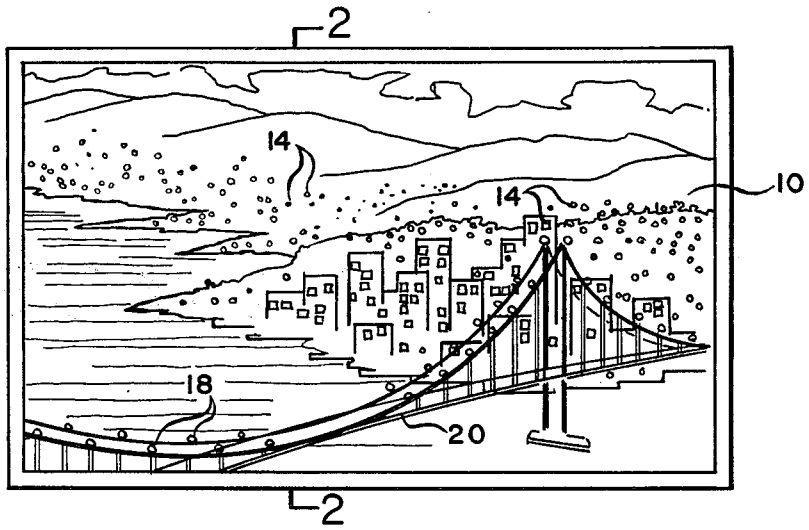
FIG. 1 is a front elevation of a day-night picture constructed in accordance with this invention.

FIG. 1 illustrates the appearance to an observer of a day-night picture constructed in accordance with this invention. The picture 10, which is mounted at the front of a box-like frame 12, may preferably represent a distant view of a city with tall buildings and homes scattered along hillsides, although other scenes of similar artistic import (e.g. a starlit sky) may of course be used.

The typical scene for which this invention is useful would, in a nighttime view, show a large number of very small lights. In a typical embodiment showing a city scene, these individual lights may number more than a thousand. To provide this lighting effect, a large number of very small apertures 14 are formed in the picture 10 where lights are to appear at night. These apertures are small, and they preferably coincide with artistic elements of the picture in such a way that they will not be noticed by an observer looking at the picture across a room in the daylight.

Figure 3:
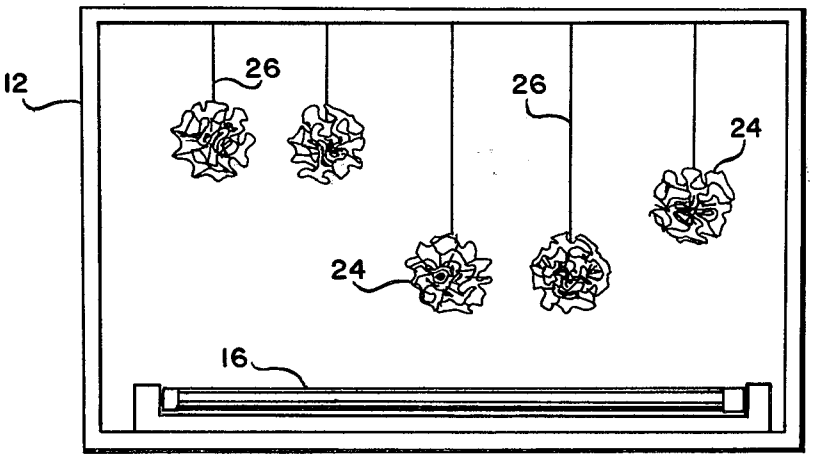
FIG. 3 is a vertical section along line 3—3 of FIG. 2.
Figure 2:
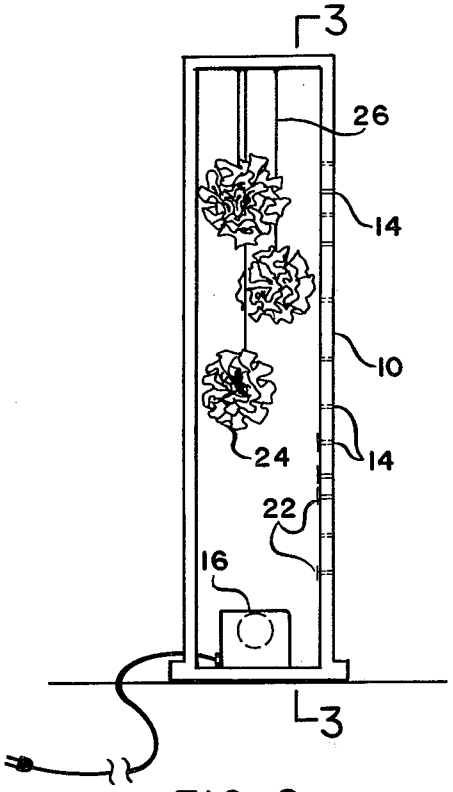
FIG. 2 is a vertical section along line 2—2 of FIG. 1.

Referring now to FIGS. 2 and 3, the nighttime effect is created by a light source 16, such as a fluorescent fixture, extending substantially the entire length of the picture 10 along the rear bottom portion of the box 12. It will be noted in the picture 10 shown in FIG. 1 that the bottom portion of the picture (where the light source 16, rather than the reflectors 24, are the dominant source of illumination) is a foreground in which there are not many lights, and in which those lights which do appear are relatively close to the observer (and therefore are not as prone to twinkling at night). Lights of a special color, such as for example yellowish halogen lamps 18 on the bridge 20 in picture 10, may be obtained by an appropriately colored cellophane backing 22 behind the corresponding apertures 14 on the back of the picture.

The twinkling effect is obtained by a series of movable random reflectors such as crumpled pieces of aluminum foil 24 suspended from thin threads 26 which are attached to the top of the frame box 12. The heat from the light fixture 16 creates convection currents within the frame box 12 which cause the reflectors 24 to move back and forth, twist and turn on their suspension threads 26 in a totally random manner. The crumpled aluminum foil of which the reflectors 24 are composed has a myriad of tiny reflective surfaces oriented in different directions so as to reflect a highly random varying illumination pattern against the backing of the picture 10. In other words, the apertures 14 of the picture 10 are illuminated with light levels of varying degrees of steadiness, ranging gradually from an essentially steady illumination in front of the light source to an increasingly twinkling illumination in areas of the picture remote from the light source where the reflected light provides a larger proportion of the total illumination.

Although incandescent light sources produce stronger convection currents for a given level of illumination, a more pleasing effect is usually obtained by using a fluorescent light source. The milder convection currents produced by a fluorescent light source result in slower movement of the foil reflectors and prevent unnaturally fast movement of the reflections.

The reflectors 24 may preferably be positioned so as to be generally located behind the major clusters of lights (such as a housing development or a downtown business area) in the picture. Color variations in the nighttime effect may be achieved by using colored aluminum foil in one or more of the reflectors 24. For example, pink aluminum foil, when illuminated by fluorescent light, tends to produce a lighting effect similar to the incandescent light normally found in homes. Plain aluminum foil, on the other hand, when reflecting the fluorescent light of the fixture 16, tends to give more of the impression of the fluorescent lights commonly seen in the business areas of the city.

I claim:

1. A day-night picture assembly comprising:

(a) a generally opaque picture having a large number of small translucent apertures therein;

(b) a generally opaque frame forming an enclosure behind said picture;

(c) a light source disposed in said enclosure; and (d) randomly movable, multi-faceted reflector means consisting of balls of crumpled reflective foil, each ball suspended from the top of said enclosure behind said picture by a single thread-like, easily twistable suspensions means, said reflector means being movable back and forth and capable of turning and twisting;

(e) said light source being of a heat-producing type and being so positioned within said enclosure as to expose said reflector means to convection air currents generated by the heat produced by said light source, said convection air current causing said back and forth and turning and twisting movement of said reflector means.

2. The picture assembly of claim 1, in which said light source is fluorescent.

3. The picture assembly of claim 1, in which said light source is positioned along the bottom of said enclosure.

4. The picture assembly of claim 1, in which said apertures are disposed generally in clusters, and said reflector means are positioned generally behind said clusters.

5. The picture assembly of claim 1, in which at least one of said reflector means is colored.

6. The picture assembly of claim 1, in which said translucent apertures are to be illuminated at light levels of varying steadiness, and in which said light source is disposed generally behind those apertures requiring the greatest steadiness.

7. The picture assembly of claim 5, in which some of said reflector means are arranged to reflect a color simulating fluorescent light and some are arranged to reflect a color simulating incandescent light.

* * * * *

UNITED STATES PATENT AND TRADEMARK OFFICE

CERTIFICATE OF CORRECTION

PATENT NO. : 4,345,395

DATED : August 24, 1982

INVENTOR(S) : Gloria Grassi

It is certified that error appears in the above—identified patent and that said Letters Patent is hereby corrected as shown below:

| | |
|---|---|
| Col. 2, line 22 | After "night)." INSERT --In other words, the apertures 14 of the picture 10 are illuminated with light levels of varying degrees of steadiness, ranging gradually from an essentially steady illumination in front of the light source to an increasingly twinkling illumination in areas of the picture remote from the light source where the reflected light provides a larger portion of the total illumination.-- |
| Col. 2, line 41 | After "10." DELETE --In other words, the apertures 14 of the picture 10 are illuminated with light levels of varying degrees of |

UNITED STATES PATENT AND TRADEMARK OFFICE

CERTIFICATE OF CORRECTION

PATENT NO. : 4,345,395

DATED : August 24, 1982

INVENTOR(S) : Gloria Grassi

It is certified that error appears in the above—identified patent and that said Letters Patent is hereby corrected as shown below:

Col. 2, line 41 steadiness, ranging gradually from an essentially steady illumination in front of the light source to an increasingly twinkling illumination in areas of the picture remote from the light source where the reflected light provides a larger portion of the total illumination.--

Col. 3, line 14 "suspensions" should read --suspension--.

Signed and Sealed this

Fifth Day of April 1983

[SEAL]

Attest:

GERALD J. MOSSINGHOFF

Attesting Officer

Commissioner of Patents and Trademarks